United States Patent [19]

Farris

[11] 4,356,647

[45] Nov. 2, 1982

[54] APPARATUS FOR HOLDING AND DISPLAYING A POSTER

[76] Inventor: William H. Farris, 3505 Alma, Manhattan Beach, Calif. 90266

[21] Appl. No.: 253,795

[22] Filed: Apr. 13, 1981

[51] Int. Cl.[3] ..... G09F 1/12

[52] U.S. Cl. ..... 40/152.1; 40/10 D; 40/155; 40/156

[58] Field of Search ..... 40/152, 152.1, 155, 40/617, 604, 11 R; 24/81 B

[56] References Cited

U.S. PATENT DOCUMENTS

| | | | |
|---|---|---|---|
| 1,778,636 | 10/1930 | Herbert | 40/152.1 |
| 1,807,288 | 5/1931 | Herbert | 40/152.1 |
| 1,809,786 | 6/1931 | LeJeune | 40/152.0 |
| 3,425,147 | 2/1969 | Marx | 40/155.0 |
| 3,665,628 | 5/1972 | Dammond | 40/155.0 |
| 3,914,892 | 10/1975 | Mohr | 40/152.0 |
| 4,089,129 | 5/1978 | Patterson | 40/617.0 |
| 4,187,630 | 2/1980 | Giulie et al. | 40/152.0 |
| 4,310,976 | 1/1982 | Wilten | 40/152.1 |

*Primary Examiner*—Gene Mancene
*Assistant Examiner*—Wenceslao J. Contreras
*Attorney, Agent, or Firm*—Edward E. Roberts

[57] ABSTRACT

An apparatus for holding and displaying a poster of a generally flexible material, the apparatus including first and second generally identical members with a longitudinal generally V-shaped groove in a long edge thereof for receiving an edge of the poster therein with a suitable fastener urging the free ends of the groove together for captively retaining the edge of the poster. One of the members is provided with a hanger mechanism for suspending the assembled unit.

9 Claims, 7 Drawing Figures

FIG. 1.
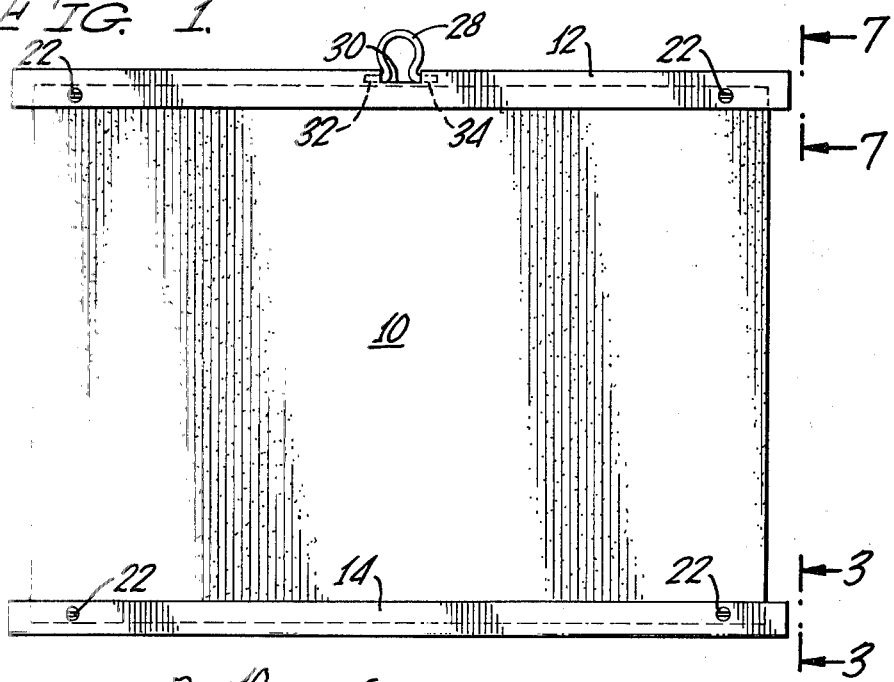
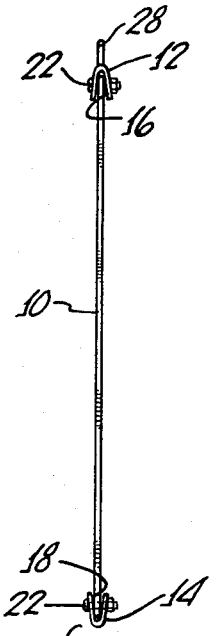
FIG. 2.
FIG. 3.
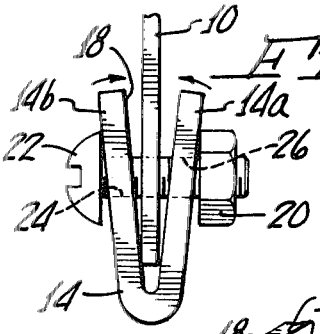
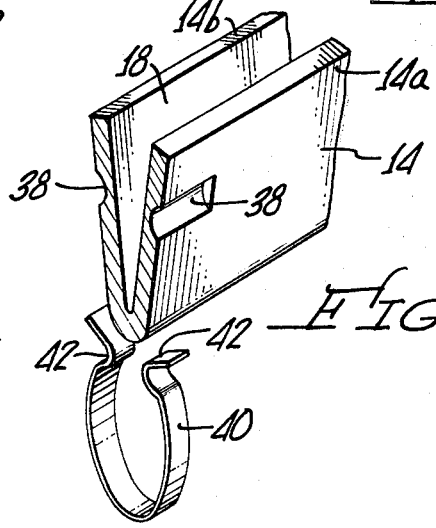
FIG. 4.
FIG. 5.
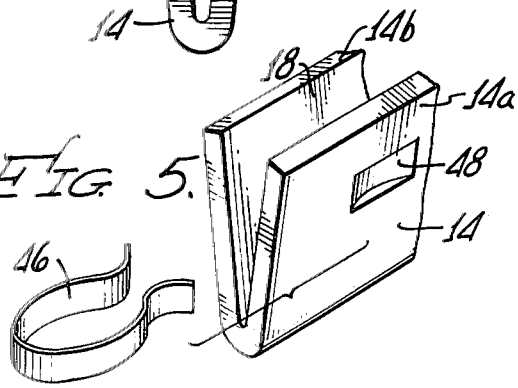
FIG. 6.
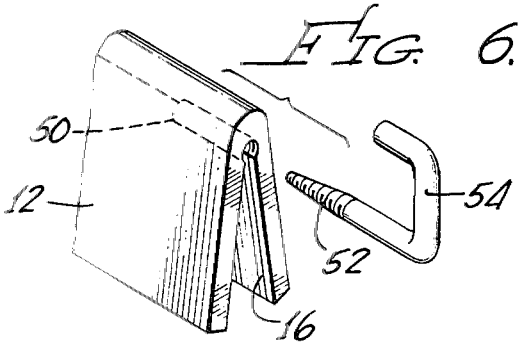
FIG. 7.
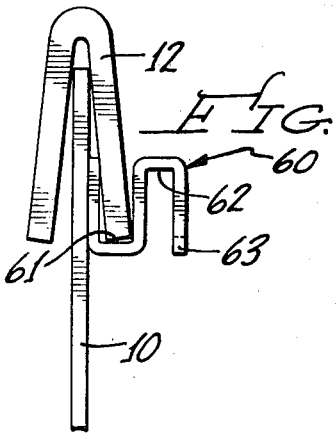

APPARATUS FOR HOLDING AND DISPLAYING A POSTER

BACKGROUND OF THE INVENTION

The background of the invention will be discussed in two parts:

Field of the Invention

This invention relates to an apparatus for holding and displaying a poster of a generally flexible material.

Description of the Prior Art

In recent years, posters of celebrities or other depictions have become very popular, such posters ordinarily being imprinted on a paper material normally purchased in coiled tubular form. Heretofore, such posters have generally been affixed to a surface by means of tacks or tape.

Prior art devices have been utilized for maintaining poster material of paper or cardboard. One such device is shown and described in U.S. Pat. No. 798,660 issued to Carrier on Sept. 5, 1905 for suspending a wall map of flexible material. The device of this patent includes a flexible material having weighted sticks attached to opposite edges with the map itself being suspended over a roller, the stick having a length greater than the length of the roller for permitting engagement of extending edges of the sticks with stop members or brackets. The device is intended for displaying maps printed on both sides of the material.

U.S. Pat. No. 1,715,061 issued to Doyle on May 28, 1929 discloses an advertising sign having generally rigid members on opposite edges with the material being interleaved into and bent with the sheet metal material comprising and reinforced edge members. The members are nonremovable and nonreusable.

U.S. Pat. No. 1,881,736 issued to Lichter on Oct. 11, 1932 discloses a display sheet in which reinforcing rod members are sewn into pockets on opposite edges of the display sheet.

U.S. Pat. No. 2,882,630 issued to Frey on Apr. 21, 1959 discloses a banner mounting construction having reinforcing rods sewn into pockets formed in opposite edges of the display sheet with a bracket mounting arrangement for securing the same to a column.

U.S. Pat. No. 3,309,805 issued to Thomas on Mar. 21, 1967 discloses a holder for cards in which each edge includes a pair of elongated substantially rigid flat members positioned on opposite sides of the edge and secured face to face by a grommet.

U.S. Pat. No. 3,310,899 issued to Hart, el al on Mar. 28, 1967 discloses a suspended pole banner construction having upper and lower members of different constructions, each including a keyhole shaped longitudinal slot. Each edge of the banner is provided with a pocket for receiving a rod-like member of a smaller diameter than the circular portion of the keyhole slot for retaining the banner within the slot.

U.S. Pat. No. 3,263,356 issued to Gilmoure, et al on Aug. 2, 1966 discloses a banner mounting construction in which opposite edges of the banner material contain pockets for receiving therein generally rigid members for securing the same to a column.

It is an object of the present invention to provide a new and improved apparatus for holding and displaying a poster of a generally flexible material.

It is another object of the present invention to provide a new and improved apparatus including first and second generally identical members configured for engaging opposite edges of a poster material for suspending the same with the members being removable and reusable.

It is a further object of the present invention to provide a new and improved apparatus for holding and displaying a poster of a generally flexible material wherein first and second generally identical members are formed of a plastic material which may be suitably imprinted, embellished or formed of a flourescent plastic material.

SUMMARY OF THE INVENTION

The foregoing and other objects of the invention are accomplished by providing an apparatus having first and second generally identical members, each of the members having a longitudinally extending V-shaped slot therein for receiving one edge of the poster. The member is formed from a material which has a slight amount of resilience and fastening means are provided for urging the open ends of the slot together for captively retaining the edge of the poster material therein. The fastening means may include screw members or spring clips. One of the members is provided with suspending means such as a wire member extending through the slot with the ends of the wire member suitably configured for suspension. Alternatively, a hanger hook may be provided generally centrally of one of the members. As another alternative, opposing ends of the slot in one of the members may be provided with apertures for receiving screw fasteners therein. Or, beveled holes may be provided in one member for hanging.

The material from which each of the members is formed is preferably a plastic material which may be readily formed from a rectangular strip by bending about a hot wire to thereby form the V-shaped slot.

Other objects, features and advantages of the invention will become apparent from a reading of the specification when taken in conjunction with the drawings in which like reference numerals refer to like elements in the several views.

BRIEF DESCRIPTION OF THE DRAWINGS

FIG. 1 is a front view of the apparatus for holding and displaying a poster in accordance with the invention;

FIG. 2 is a side elevational view of the apparatus of FIG. 1;

FIG. 3 is an enlarged partial end view of one of the members viewed along line 3—3 of FIG. 1;

FIG. 4 is an exploded perspective view, partially in cross-section and partially broken away of an alternative fastening arrangement;

FIG. 5 is an exploded perspective view, partially broken away, illustrating an alternative fastening arrangement;

FIG. 6 is an exploded perspective view, partially broken away, illustrating an alternative suspending arrangement; and FIG. 7 is an enlarged partial end view of one of the members viewed alone line 7—7 of FIG. 1.

DESCRIPTION OF THE PREFERRED EMBODIMENT

Referring now to the drawings and particularly to FIG. 1 there is shown an assembly including a poster 10 of generally flexible material suspended between first and second generally identical members 12 and 14 attached to opposite edges of the poster 10. Referring also to FIGS. 2 and 3, each of the members 12 and 14 is generally identical and comprises an elongate member having a generally V-shaped groove 16 and 18 respectively through the length thereof. Each of the grooves 16 and 18 is configured for receiving therein one edge of the poster 10.

The material from which members 12 and 14 is formed is preferably plastic with the method of forming the members preferably consisting of a hot wire or "cal" rod positioned at the longitudinal midpoint of a planar sheet of elongated rectangular plastic and bent about the constant temperature heater wire to form opposing sides 14*a*, 12*b* defining V-shaped groove or slot 18. Although plastic is the preferred material, the material selection should be based upon general rigidity with slight flexibility to permit the open ends of the V-shaped slot 18 (see FIG. 3) to be urged together after receipt therein of one edge of the poster 10.

Although the use of the "cal" rod is the preferred method of forming the members, other methods will occur to those skilled in the art. For instance, a solid piece of material with the V-shaped slot formed by a "saw cut" is an alternate method. Further, each of the members could be formed from two separate pieces of material.

As illustrated in FIG. 3, after insertion of one edge of the poster 10 within the V-shaped slot 18, suitable fastening means such as a nut 20 and screw 22 pass through aligned apertures 24 and 26 extending through opposing sides 14*a*, 14*b* respectively of the material of member 14 (and through apertures in the poster 10). Tightening of the nut and bolt assembly 20 and 22 urges the free ends of the material on opposite sides 14*a*, 14*b* of the slot 18 together for captively retaining the edge of the poster 10 therein.

An alternate fastening arrangement would exclude the nut 20 and provide aperture 26 with matching female threads, aperture 26 extending at least part way through the respective opposing side 14*a* of the material. A further alternate arrangement would further exclude aperture 26 altogether and provide aperture 24 with matching female threads, screw 22 being foreshortened and providing pressure against the poster, as a fastening means, when screwed into threaded aperture 24.

As illustrated in FIGS. 1 and 2, four fasteners 22 are utilized at positions adjacent the corners of the poster 10 for captively retaining the poster 10 upper and lower edges within the slots of the upper and lower members 12 and 14. For the purpose of suspending the so-assembled unit, at the approximate midpoint of the upper member 12, a portion of the material is removed to permit insertion of a horseshoe shaped spring member 28 which forms a hanger hook. The transverse slot 30 at the midpoint of member 12 extends into the groove formed therein so that the spring member 28 may be compressed, positioned into the slot 30, with the aligned free ends 32 and 34 thereof extending into adjacent portions of the groove upon release of the spring member 28.

FIGS. 4 and 5 depict alternate fastening means for urging opposing faces of the member 14 (or the member 12) together. In FIG. 4, the opposing outer faces of the member 14 are provided with aligned dimples or detents 38 and a fastening member 40 in the form of a horseshoe shaped spring clip is provided. The clip 40, at the free ends thereof includes inwardly extending aligned portions 42 matingly configured for being received within the detents 38 with the clip 40 urged around the apex of the member 14 to urge the free ends together.

An alternate arrangement is shown in FIG. 5 in which a similarly configured clip member 46 is inserted over each end of the member 14 in the longitudinal direction thereof for engaging mating detents 48 formed in the material itself.

Any of the fastening means disclosed herein may be conveniently employed, the primary purpose being to urge opposite faces of the V-shaped groove 18 toward each other after insertion of the material 10 for the purpose of captively retaining the poster edge therein.

Referring now to FIG. 6, an alternate arrangement of suspending the assembly is depicted, this arrangement including an aperture 50 drilled longitudinally into the apex of the end of the groove 16 of the upper member 12. The aperture 50 may or may not be threaded for receiving the threaded end 52 of a hanger member 54 configured as a hook. It is to be understood that the opposite edge of the member 12 would be similarly configured for receiving a second hook member 54 for suspending the assembly. Although not shown, a string or wire member may be run through the groove 16 of the upper member 12 prior to insertion of the edge of the poster 10 with the string or wire member being used to suspend the assembly. Also not shown, one or more holes or indentations may be provided in one or more of the members for suspending the assembly, the holes or indentations preferably slanting upwardly into the material.

Referring now to FIG. 7, yet another alternate arrangement of suspending the assembly is depicted, this arrangement including an "S" shaped hanging mechanism 60, one open portion 61, of said "S" shaped arrangement configured for accepting the bottom of the upper member 12, with the other open portion 62 terminated in jagged teeth 63 for suspending the assembly from a nail or the like.

With the construction and configuration of the apparatus of the present invention, each of the members 12 and 14 is generally idential to facilitate manufacture and assembly. Slight modifications to one of the members are effected for providing a suspension mechanism. With the selection of plastic as the material for the members 12 and 14, the plastic may be transparent, translucent, colored, or even flourescent for providing a pleasing aesthetic appearance. In addition, by the selection of plastic as the material, embossing, lettering or even personalizing by affixing names on the visible surface thereof may be readily accomplished. In accordance with the present invention a simple yet economical apparatus is disclosed and described for providing rigidity to a poster formed of generally flexible material and for suspending the assembled unit. No operations are required to be performed on the poster material itself such as the formation of pockets or the like for the use of the invention. Furthermore, the reinforcing members 12 and 14 may be removed and reused for other posters innumerable times.

While there has been shown and described a preferred embodiment, it is to be understood that various other adaptations and modifications may be made within the spirit and scope of the invention.

What is claimed is:

1. In an apparatus for holding and displaying a poster of a generally flexible material, the combination comprising:

first and second generally identical members, each of said members being formed from an elongate generally rectangular piece of generally rigid yet slightly flexible plastic material bent at the approximate center thereof to form first and second opposing sides defining a longitudinally extending generally V-shaped slot for receiving an edge of the poster therein;

fastening means for urging the free ends of said member adjacent the mouth of said slot toward each other for captively retaining the so-engaged edge of the poster therein; and means engaging the V-shaped slot on one of said members for suspending the assembled unit.

2. The combination according to claim 1 wherein each of said members has at least one aperture extending through at least said first opposing side and said fastening means includes screw means configured for passing at least through said at least one aperture for retaining said poster therein.

3. The combination according to claim 2 wherein said aperture further extends into said second opposing side and said screw means passes through the portion of poster material therein and into said second opposing side.

4. The combination according to claim 3 wherein said aperture extends through said first and second opposing sides and said fastening means further includes nut means for engaging said screw means, said screw means passing through both of said first and second opposing sides.

5. The combination according to claim 1 wherein said means for suspending includes at least one indentation extending into at least one of said members.

6. The combination according to claim 1 wherein said means for suspending includes a hanger hook device fitted within a slot at the general midpoint of said member.

7. The combination according to claim 1 wherein said means for suspending includes aligned aperture means in opposite ends of said member and a threaded generally hook-shaped member for insertion into each of said apertures.

8. The combination according to claim 1 wherein said fastening means includes generally horseshoe-shaped clip means for engaging opposing points on the outer surface of each of said members.

9. The combination according to claim 8 wherein each of said members is detented at the points of engagement of said clip means.

* * * * *